US011013332B2

(12) United States Patent
Xiao et al.

(10) Patent No.: US 11,013,332 B2
(45) Date of Patent: May 25, 2021

(54) STORAGE DEVICE

(71) Applicant: Xiamen Solex High-Tech Industries Co., Ltd., Xiamen (CN)

(72) Inventors: Zhenjia Xiao, Xiamen (CN); Fufeng Lin, Xiamen (CN); Hanli Ding, Xiamen (CN)

(73) Assignee: Xiamen Solex High-Tech Industries Co., Ltd., Xiamen (CN)

( * ) Notice: Subject to any disclaimer, the term of this patent is extended or adjusted under 35 U.S.C. 154(b) by 0 days.

(21) Appl. No.: 16/822,140

(22) Filed: Mar. 18, 2020

(65) Prior Publication Data

US 2020/0297118 A1 Sep. 24, 2020

(30) Foreign Application Priority Data

Mar. 18, 2019 (CN) ..... 201910205365.0

(51) Int. Cl.
*B64D 11/06* (2006.01)
*A47C 7/70* (2006.01)

(52) U.S. Cl.
CPC ..... *A47C 7/70* (2013.01)

(58) Field of Classification Search
CPC ..... A47C 7/70; A47C 7/624
USPC ..... 297/173, 188.21
See application file for complete search history.

(56) References Cited

U.S. PATENT DOCUMENTS 624,812 A * 5/1899 Hunzinger ..... A47C 7/70 297/145
1,726,109 A * 8/1929 Jost ..... A47C 7/70 297/145
1,753,423 A * 4/1930 Kroschel ..... A47B 5/04 108/37
1,907,322 A * 5/1933 Keigher ..... A47C 7/70 297/145
2,502,383 A * 3/1950 Osofsky ..... A47C 7/70 297/145
3,042,467 A * 7/1962 Germick ..... A47C 7/70 312/235.8
3,717,375 A * 2/1973 Slobodan ..... A47B 83/02 297/162
3,972,560 A * 8/1976 White ..... A47B 83/02 297/145
5,035,464 A * 7/1991 Spallholtz ..... A47C 7/70 297/144
5,217,277 A * 6/1993 Rasnick ..... A47C 7/62 297/145
5,294,177 A * 3/1994 Rasnick ..... A47B 43/02 297/270.1
5,651,587 A * 7/1997 Kodaverdian ..... B60N 2/0228 297/423.36

(Continued)

*Primary Examiner* — Shin H Kim
(74) *Attorney, Agent, or Firm* — Cooper Legal Group, LLC

(57) ABSTRACT

The present disclosure discloses a storage device connected to a support portion. The storage device comprises a storage portion configured for movement relative to the support portion. The storage device further comprises a driving mechanism and a sensor unit configured to determine whether an object is present on the storage portion. The driving mechanism is configured to drive the storage portion so as to control the storage portion to move between at least an in-use state and a non-use state. The sensor unit is communicatively connected to the driving mechanism and is configured to control the driving mechanism to keep the storage portion in the in-use state when the sensor unit determines that there is an object on the storage portion.

10 Claims, 7 Drawing Sheets

(56) References Cited

U.S. PATENT DOCUMENTS

| | | | | |
|---|---|---|---|---|
| 6,255,790 | B1 * | 7/2001 | Popp | B60N 2/002 307/10.1 |
| 6,412,862 | B1 * | 7/2002 | Dickerson | A47C 7/70 297/161 |
| 6,526,643 | B1 * | 3/2003 | Renault | B60N 2/0244 29/407.05 |
| 6,916,069 | B2 * | 7/2005 | Bauer | A47C 1/0352 297/423.3 |
| 8,434,415 | B1 * | 5/2013 | Federici | A47C 7/62 108/42 |
| 10,039,385 | B2 * | 8/2018 | Shih | A47C 20/08 |
| 10,106,260 | B2 * | 10/2018 | Gagnon | B64D 11/0638 |
| 2002/0070591 | A1 * | 6/2002 | Nivet | B64D 11/00155 297/217.3 |
| 2002/0105212 | A1 * | 8/2002 | Nivet | B60N 2/22 297/83 |
| 2011/0012393 | A1 * | 1/2011 | Kanthasamy | A47C 17/62 297/173 |
| 2012/0049585 | A1 * | 3/2012 | Kim | B60N 3/002 297/173 |
| 2013/0249256 | A1 * | 9/2013 | Payne, Jr. | A47C 7/624 297/161 |
| 2014/0252811 | A1 * | 9/2014 | Whalen | B60N 3/002 297/144 |
| 2016/0000222 | A1 * | 1/2016 | Calderone | A47B 23/00 297/173 |
| 2020/0297117 | A1 * | 9/2020 | Xiao | A47C 7/70 |
| 2020/0297118 | A1 * | 9/2020 | Xiao | A47C 7/70 |

* cited by examiner

STORAGE DEVICE

RELATED APPLICATIONS

This application claims priority to Chinese Patent Application 201910205365.0, filed on Mar. 18, 2019. Chinese Patent Application 201910205365.0 is incorporated herein by reference.

FIELD OF THE DISCLOSURE

The present disclosure relates to the field of household products, and in particular to a storage device.

BACKGROUND OF THE DISCLOSURE

A conventional storage device is connected to a support portion and comprises a storage portion that movably connects to the support portion. The storage portion moves relative to the support portion at least between an in-use state and a non-use state. During use, when there is an object on the storage portion, erroneous operation often causes the storage portion to move from the in-use state to the non-use state, thereby causing the object on the storage portion to fall and causing damage to the object when the object falls to the ground or causing the ground to be messy.

BRIEF SUMMARY OF THE DISCLOSURE

The present disclosure provides a storage device that overcomes the disadvantages of the storage device of the prior art.

One of the technical solutions adopted by the present disclosure is a storage device connected to a support portion. The storage device comprises a storage portion configured for movement relative to the support portion. The storage device further comprises a driving mechanism and a sensor unit configured to determine whether an object is present on the storage portion. The driving mechanism is configured to drive the storage portion so as to control the storage portion to move between at least an in-use state and a non-use state. The sensor unit is communicatively connected to the driving mechanism and is configured to control the driving mechanism to keep the storage portion in the in-use state when the sensor unit determines that there is an object on the storage portion.

In a preferred embodiment, the storage portion comprises a storage surface and a protrusion base protruding from the storage surface. The sensor unit comprises a sensor, and the sensor is disposed on the protrusion base. The sensor is at least one of an infrared sensor, a microwave sensor, or a laser sensor configured to determine whether the object is present on the storage surface.

In a preferred embodiment, the storage portion comprises a storage surface, and the sensor unit comprises a sensor that cooperates with the storage surface. The sensor is a pressure sensor configured to determine whether the object is present on the storage surface.

In a preferred embodiment, the storage portion comprises a storage panel. The sensor unit comprises a sensor, and the sensor is disposed in the storage panel.

In a preferred embodiment, the driving mechanism comprises an electric push rod. A push rod of the electric push rod is connected to the storage portion, and the sensor unit is communicatively connected to the electric push rod.

In a preferred embodiment, the storage device further comprises a first link bar, a second link bar, a third link bar, and a fourth link bar. The first link bar and the third link bar are respectively pivotally connected to the support portion, and the second link bar and the fourth link bar are respectively pivotally connected to the storage portion. The first link bar and the third link bar are pivotally connected, the second link bar and the fourth link bar are pivotally connected, and the second link bar and the third link bar are pivotally connected.

In a preferred embodiment, the second link bar, the third link bar, the fourth link bar, and the storage portion cooperate to form a first four-bar linkage, and the first link bar, the second link bar, the third link bar, and the support portion cooperate to form a second four-bar linkage.

In a preferred embodiment, the driving mechanism is connected to the first link bar to drive the first link bar to rotate.

In a preferred embodiment, the storage portion comprises a storage panel and a fixed base fixed to a back surface of the storage panel. The second link bar and the fourth link bar are pivotally connected to the fixed base of the storage portion.

A second technical scheme in the present disclosure is a storage device connected to a support portion. The storage device comprises a storage portion movably connected to the support portion, a locking mechanism, and a sensor unit disposed at the storage portion and configured to determine whether an object is present on the storage portion. The storage portion moves relative to the support portion at least between an in-use state and a non-use state. The locking mechanism is connected to the storage portion and movable between a locked state and a released state. The locking mechanism, while located in the locked state, is configured to control the storage portion to be kept in the in-use state. The sensor unit is communicatively connected to the locking mechanism and is configured to control the locking mechanism to remain in the locked state when the sensor unit determines that the object is present on the storage portion.

Compared with existing techniques, the technical solution provided by the present disclosure has the following advantages.

The sensor unit is communicatively connected to the driving mechanism and the sensor unit controls the driving mechanism to keep the storage portion in the in-use state when the sensor unit determines that an object is present on the storage portion, thereby inhibiting the driving mechanism from driving the storage portion to move to the non-use state when the storage portion is in the in-use state and an object is present on the storage portion and avoiding the object from falling to the ground. The driving mechanism drives the storage portion to move from the in-use state to the non-use state only when there is no object on the storage portion.

The sensor is arranged on the protrusion base, and the sensor is an infrared sensor or a microwave sensor for determining whether there is an object on the storage panel. Detection of the object is reliable and accurate.

The first link bar and third link bar are respectively pivotally connected to the support portion, and the second link bar and the fourth link bar are respectively pivotally connected to the storage portion. The first link bar and the third link bar are pivotally connected, the second link bar and the fourth link bar are pivotally connected, and the second link bar and the third link bar are also pivotally connected. The folding and unfolding of the storage portion are smooth, labor-saving, and convenient, and support of the storage portion is stable and reliable.

The second link bar, the third link bar, the fourth link bar, and the storage portion cooperate to form a first four-bar linkage, and the first link bar, the second link bar, the third link bar, and the support portion cooperate to form a second four-bar linkage. The folding and unfolding of the storage portion are smooth, labor-saving, and convenient, and support of the storage portion is stable and reliable.

The driving mechanism is connected to the first link bar to drive the first link bar to rotate, which can realize automatic folding and unfolding of the folding mechanism without manual operation, and the storage device is convenient to use.

The driving mechanism comprises an electric push rod, and the push rod of the electric push rod forms an abutting portion. The electric push rod can realize self-locking to ensure that the storage portion is maintained in an unfolded state or a folded state.

The second link bar and the fourth link bar can be pivotally connected to the fixed base of the storage portion for convenient assembly and high connection strength.

BRIEF DESCRIPTION OF THE DRAWING

The present disclosure will be further described below with the combination of the accompanying drawings and the embodiments.

DETAILED DESCRIPTION OF THE EMBODIMENTS

Referring to FIGS. 4-7, a storage device of this embodiment is connected to a support portion 20, and the storage device comprises a storage portion 10 configured for movement relative to the support portion 20, a driving mechanism 40, and a sensor unit 100 for determining whether an object is present on the storage portion 10. The driving mechanism 40 drives the storage portion 10 so as to control the storage portion 10 to move between at least an in-use state, such as an unfolded state, and a non-use state, such as a folded state. The sensor unit 100 is communicatively connected to the driving mechanism 40. When the storage portion 10 is in the in-use state and when the sensor unit 100 determines that there is an object on the storage portion 10, the driving mechanism 40 is controlled by the sensor unit 100 to keep the storage portion 10 in the in-use state, thereby preventing the driving mechanism 40 from driving the storage portion 10 to move to the non-use state when the object is present on the storage portion 10 and thereby preventing the object on the storage portion 10 from falling. The driving mechanism 40 drives the storage portion 10 to move from the in-use state to the non-use state only when there is no object on the storage portion 10.

Figure 1:
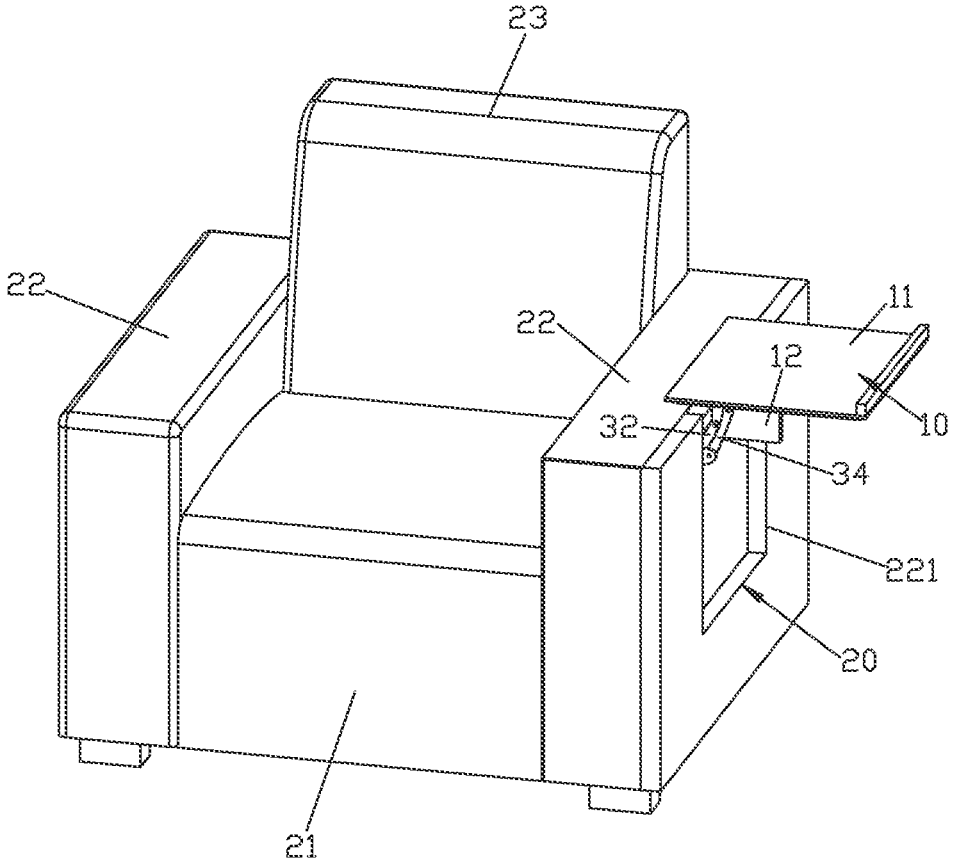
FIG. 1 is a perspective view showing a storage panel of a sofa of an embodiment in an unfolded state.
Figure 2:
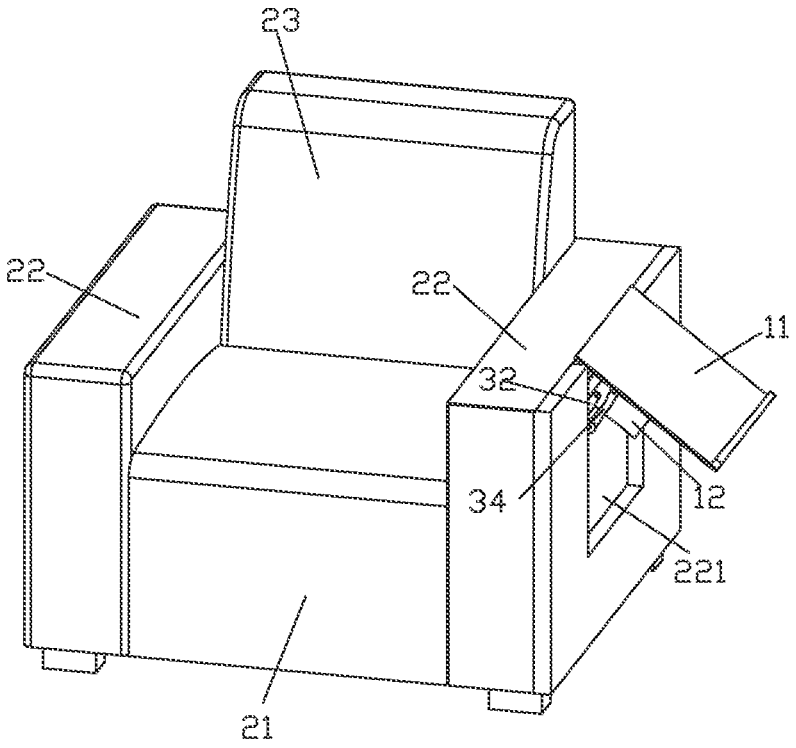
FIG. 2 is a perspective view showing the storage panel of the sofa of the embodiment in a half-folded state.
Figure 3:
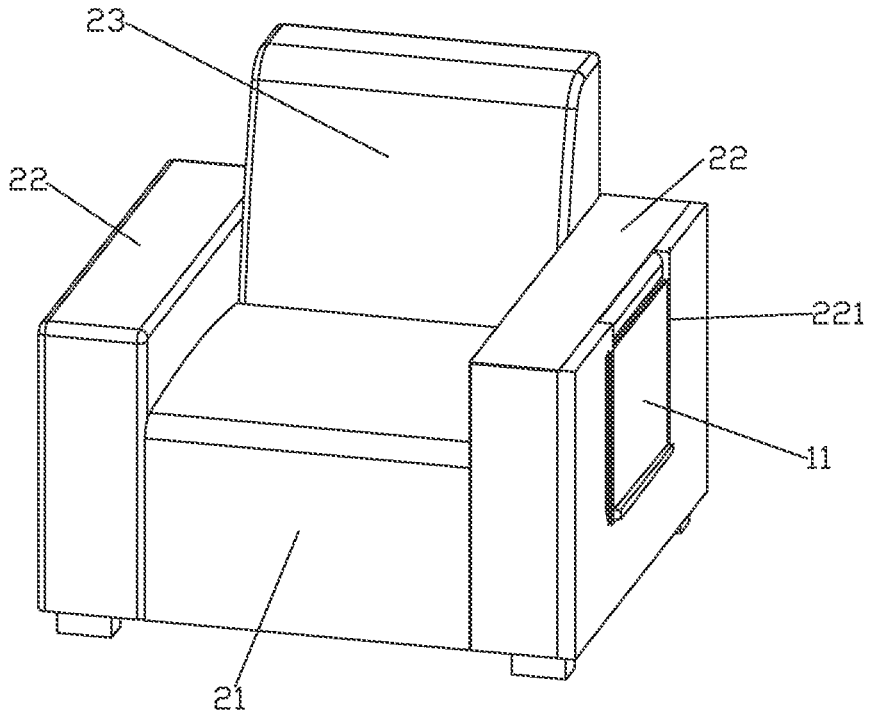
FIG. 3 is a perspective view showing the storage panel of the sofa of the embodiment in a folded state.
Figure 4:
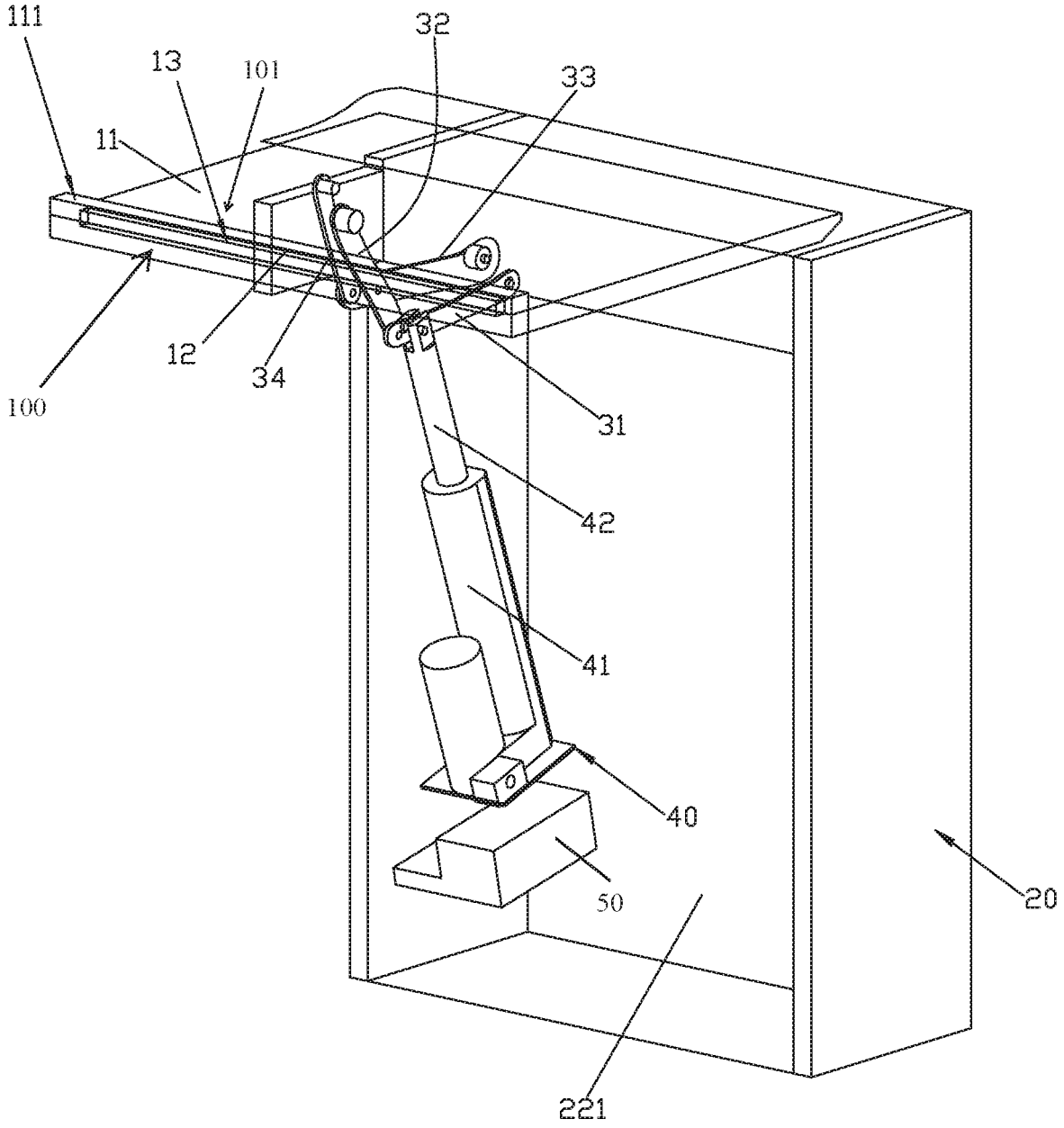
FIG. 4 is a perspective view of a storage device of the embodiment, in which the storage panel is indicated by a broken line.
Figure 5:
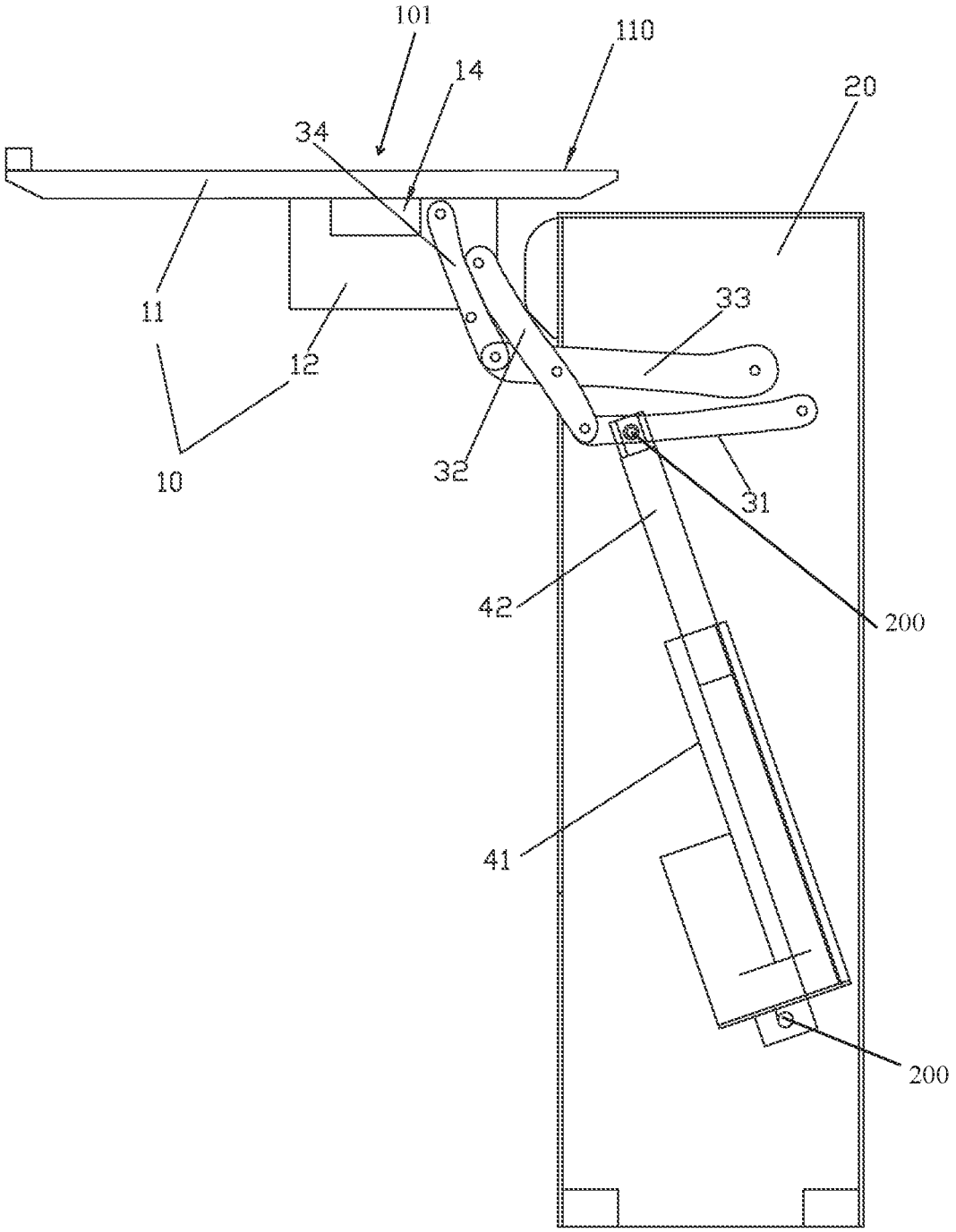
FIG. 5 is a schematic view showing the storage device of the embodiment in an unfolded state.
Figure 6:
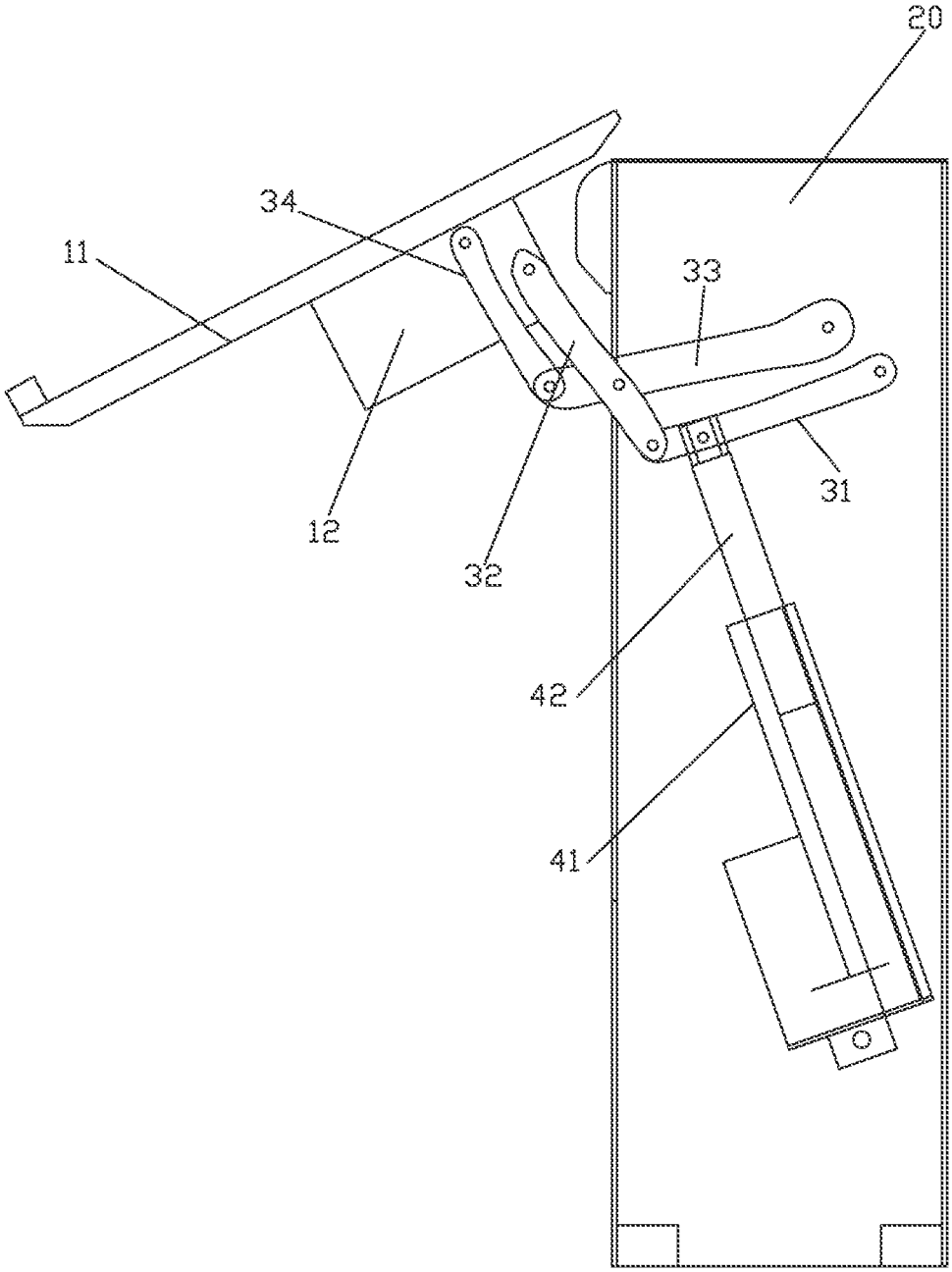
FIG. 6 is a schematic view showing the storage device of the embodiment in a half-folded state.
Figure 7:
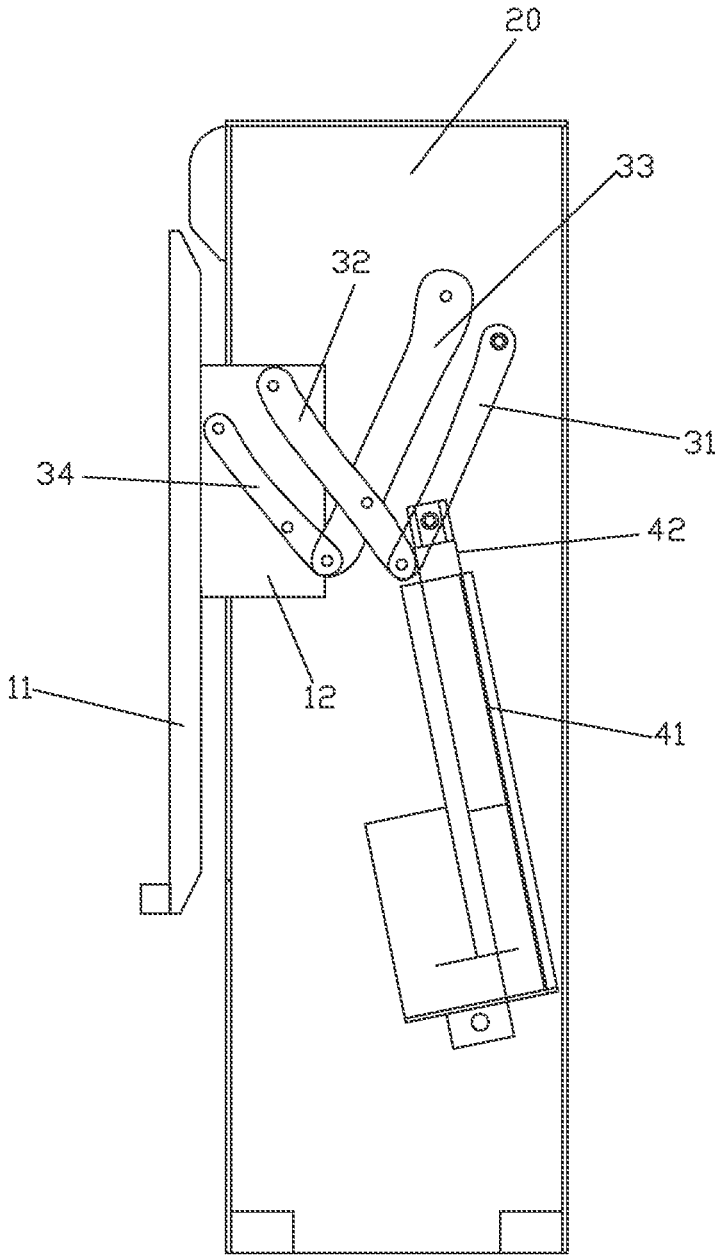
FIG. 7 is a schematic view showing the storage device of the embodiment in a folded state.

The storage portion 10 comprises a storage panel 11 and a fixed base 12 fixed to a back surface of the storage panel 11. The storage panel 11 is a table panel or other storage component such as a bracket, a tray, etc. The storage panel 11 has a storage surface 110 (i.e. a top surface when the storage device is in the unfolded state as illustrated in FIG. 5) from which a protrusion base 111 protrudes. The sensor unit 100 comprises a sensor 101. The sensor 101 is disposed on the protrusion base 111. The sensor 101 may be an infrared sensor 13 for determining whether an object is present on the storage panel 11 and may be arranged parallel to a length of the protrusion base 111. The infrared sensor 13 is configured to emit infrared rays, and when an infrared ray encounters obstacles, feedback is provided to the infrared sensor 13. The infrared sensor 13 is configured to determine whether an object is present on the storage surface 110 according to whether feedback is received or not. When no feedback is received, no object is present on the storage surface 110. Other sensors, such as microwave sensors or laser sensors, can be used for the sensor instead of or in addition to the infrared sensor 13. For example, as illustrated in FIG. 5, a pressure sensor 14 may be provided on the storage surface 110 or on the protrusion base 111 and used to determine whether there is an object present on the storage surface 110. The sensor unit 100 may further comprise a control portion. The control portion is communicatively connected to the sensor 101 and sends a driving signal to the driving mechanism 40 to move the storage portion 10 from the in-use state to the non-use state when the control portion receives a signal from the sensor 101 indicating that there is no object on the storage panel 11.

The storage device further comprises a folding mechanism that connects the storage portion 10 and the support portion 20. The folding mechanism comprises a first link bar 31, a second link bar 32, a third link bar 33, and a fourth link bar 34. A first end of the first link bar 31 and a first end of the third link bar 33 are respectively pivotally connected to the support portion 20. A first end of the second link bar 32 and a first end of the fourth link bar 34 are respectively pivotally connected to the storage portion 10. A second end of the first link bar 31 and a second end of the third link bar 33 are pivotally connected, and a second end of the second link bar 32 and a second end of the fourth link bar 34 are pivotally connected. The second link bar 32 and the third link bar 33 are also pivotally connected to make the second link bar 32, the third link bar 33, the fourth link bar 34, and the storage portion 10 cooperate to form a first four-bar linkage. The first link bar 31, the second link bar 32, the third link bar 33, and the support portion 20 cooperate to form a second four-bar linkage. The first four-bar linkage and the second four-bar linkage are linked together. The driving mechanism 40 drives the first link bar 31 to rotate relative to the support portion 20. In the specific embodiment, the second link bar 32 and the fourth link bar 34 are respectively pivotally connected to the fixed base 12 of the storage portion 10.

The driving mechanism 40 comprises a driving portion 41 and an abutting portion 42 slidably connected to the driving portion 41. The driving portion 41 is pivotally connected to the support portion 20, and the abutting portion 42 is pivotally connected to the first link bar 31. In this way, sliding of the abutting portion 42 with respect to the driving portion 41 controls rotation of the first link bar 31 and controls folding and unfolding of the folding mechanism of the storage device. In some embodiments, other driving mechanisms may be employed, such as a driving gear and a driven gear that is synchronously rotatably connected to the first link bar 31. The driving gear and the driven gear may engage to drive the first link bar 31 to rotate around a rotating shaft of the driven gear to control the folding and unfolding of the folding mechanism. In the specific embodiment, the driving mechanism 40 comprises an electric push rod, and a push rod of the electric push rod constitutes the abutting portion 42. The driving mechanism 40 can also adopt other mechanisms, such as a hydraulic putter or a pneumatic putter, for example.

In the specific embodiment, the storage portion 10 is provided with a wireless charging module 50 to provide a wireless charging function for an electronic device resting on the storage panel 11.

Referring to FIGS. 1-4, a sofa comprises a sofa body and the storage device, and the sofa body is disposed with the support portion 20. The sofa body comprises a seat portion 21, two armrest portions 22 respectively located at two sides of the seat portion 21, and a back portion 23 provided at a rear of the seat portion 21. A first armrest portion of the two armrest portions 22 is disposed with the support portion 20. An outer wall of the first armrest portion of the two armrest portions 22 is recessed to define an accommodating cavity 221, and the storage portion 10 is movable between the unfolded state and the folded state by the folding mechanism. When the storage portion 10 is in the folded state, the folding mechanism and the storage panel 11 are located in the accommodating cavity 221. The storage panel 11 is placed in the accommodating cavity 221 when in the folded state and partially overlaps a top surface of the first armrest portion of the two armrest portions 22 when in the unfolded state. This configuration causes the storage panel 11 to avoid interacting with the top surface of the first armrest portion of the two armrest portions 22 during the folding and unfolding process while still enabling a user to conveniently use the storage panel 11 in the unfolded state.

The first armrest portion of the two armrest portions 22 is provided with a control panel, and the control panel is communicatively connected to the driving mechanism 40 to control the storage panel 11 to fold and unfold. In some embodiments, a Universal Serial Bus (USB) charging stand can also be disposed in the control panel.

The storage device of the present embodiment can be used not only for a sofa but also for other household items, such as tables, chairs, beds, and the like.

In a specific structure, the storage device is provided with a locking mechanism 200 that is connected to the storage portion 10 and is movable between a locked state and a released state. The locking mechanism 200, while in the locked state, can control the storage portion 10 to be kept in the in-use state. The specific locking mechanism 200 may be a latch mechanism. For example, the latch mechanism may comprise a movable latch, and the movable latch may be controlled to lock or release the latch mechanism.

The sensor unit 100 communicatively connects to the locking mechanism 200. When the storage portion 10 is in the in-use state and the sensor unit 100 determines that there is an object present on the storage portion 10, the locking mechanism 200 is controlled to remain in the locked state. For example, the latch mechanism may control the latch from reciprocating through an electromagnet mechanism. This avoids objects on the storage portion 10 from falling down. The locking mechanism 200 may be released only when there is no object on the storage portion 10, and the storage portion 10 can be moved from the in-use state to the non-use state upon the locking mechanism 200 being released.

It will be apparent to those skilled in the art that various modifications and variation can be made in the present disclosure without departing from the spirit or scope of the invention. Thus, it is intended that the present disclosure cover the modifications and variations of this invention provided they come within the scope of the appended claims and their equivalents.

What is claimed is:

1. A storage device connected to a support portion, the storage device comprising:
- a storage portion configured for movement relative to the support portion,
- a driving mechanism, and
- a sensor unit configured to determine whether an object is present on the storage portion, wherein:
  - the driving mechanism is configured to drive the storage portion so as to control the storage portion to move between at least an in-use state and a non-use state, and
  - the sensor unit is communicatively connected to the driving mechanism and is configured to control the driving mechanism to keep the storage portion in the in-use state when the sensor unit determines that there is an object on the storage portion.

2. The storage device according to claim 1, wherein:
- the storage portion comprises a storage surface and a protrusion base protruding from the storage surface,
- the sensor unit comprises a sensor,
- the sensor is disposed on the protrusion base, and
- the sensor is at least one of an infrared sensor, a microwave sensor, or a laser sensor configured to determine whether the object is present on the storage surface.

3. The storage device according to claim 1, wherein:
- the storage portion comprises a storage surface,
- the sensor unit comprises a sensor that cooperates with the storage surface, and
- the sensor is a pressure sensor configured to determine whether the object is present on the storage surface.

4. The storage device according to claim 1, wherein:
- the storage portion comprises a storage panel,
- the sensor unit comprises a sensor, and
- the sensor is disposed in the storage panel.

5. The storage device according to claim 1, wherein:
- the driving mechanism comprises an electric push rod,
- a push rod of the electric push rod is connected to the storage portion, and
- the sensor unit is communicatively connected to the electric push rod.

6. The storage device according to claim 1, wherein:
- the storage device further comprises a first link bar, a second link bar, a third link bar, and a fourth link bar,
- the first link bar and the third link bar are respectively pivotally connected to the support portion,
- the second link bar and the fourth link bar are respectively pivotally connected to the storage portion,
- the first link bar and the third link bar are pivotally connected,
- the second link bar and the fourth link bar are pivotally connected, and
- the second link bar and the third link bar are pivotally connected.

7. The storage device according to claim 6, wherein:
- the second link bar, the third link bar, the fourth link bar, and the storage portion cooperate to form a first four-bar linkage, and
- the first link bar, the second link bar, the third link bar, and the support portion cooperate to form a second four-bar linkage.

8. The storage device according to claim 6, wherein the driving mechanism is connected to the first link bar to drive the first link bar to rotate.

9. The storage device according to claim 6, wherein:

the storage portion comprises a storage panel and a fixed base fixed to a back surface of the storage panel, and the second link bar and the fourth link bar are pivotally connected to the fixed base of the storage portion.

10. A storage device connected to a support portion, the storage device comprising:

a storage portion movably connected to the support portion, a locking mechanism, and a sensor unit disposed at the storage portion and configured to determine whether an object is present on the storage portion, wherein:

the storage portion moves relative to the support portion at least between an in-use state and a non-use state, the locking mechanism is connected to the storage portion and movable between a locked state and a released state, the locking mechanism, while in the locked state, is configured to control the storage portion to be kept in the in-use state, and the sensor unit is communicatively connected to the locking mechanism and is configured to control the locking mechanism to remain in the locked state when the sensor unit determines that the object is present on the storage portion.

* * * * *